US009999336B2

(12) United States Patent
Zhu et al.

(10) Patent No.: US 9,999,336 B2
(45) Date of Patent: Jun. 19, 2018

(54) SELF-WRUNG FLAT MOP

(71) Applicant: Jiaxing Jackson Travel Products Co., Ltd., Jiaxing, Zhejiang (CN)

(72) Inventors: Xue Lin Zhu, Zhejiang (CN); Jing Li, Zhejiang (CN)

(73) Assignee: JIAXING JACKSON TRAVEL PRODUCTS CO., LTD., Jiaxing, Zhejiang (CN)

( * ) Notice: Subject to any disclaimer, the term of this patent is extended or adjusted under 35 U.S.C. 154(b) by 349 days.

(21) Appl. No.: 14/921,256

(22) Filed: Oct. 23, 2015

(65) Prior Publication Data

US 2016/0113471 A1 Apr. 28, 2016

(30) Foreign Application Priority Data

Oct. 27, 2014 (CN) ..... 2014 2 0624020 U

(51) Int. Cl.

| | |
|---|---|
| ***A47L 13/14*** | (2006.01) |
| ***A47L 13/254*** | (2006.01) |
| ***A47L 13/256*** | (2006.01) |
| ***A47L 13/44*** | (2006.01) |
| *A47L 13/58* | (2006.01) |

(52) U.S. Cl.

CPC ..... *A47L 13/14* (2013.01); *A47L 13/254* (2013.01); *A47L 13/256* (2013.01); *A47L 13/44* (2013.01); *A47L 13/58* (2013.01)

(58) Field of Classification Search

CPC ..... A47L 13/14; A47L 13/142; A47L 13/44; A47L 13/146; A47L 13/20; A47L 13/24; A47L 13/59

USPC ..... 15/119.1

See application file for complete search history.

(56) References Cited

U.S. PATENT DOCUMENTS 5,815,878 A * 10/1998 Murakami ..... A47L 13/256 15/150

FOREIGN PATENT DOCUMENTS

| | | | | |
|---|---|---|---|---|
| CN | 201171658 Y | | 12/2008 | |
| CN | 201675886 U | | 12/2010 | |
| CN | 202553837 U | | 11/2012 | |
| CN | 202843535 U | | 4/2013 | |
| FR | 2982757 A1 | * | 5/2013 | ..... A47L 13/14 |

* cited by examiner

*Primary Examiner* — Laura C Guidotti

(74) *Attorney, Agent, or Firm* — Muncy, Geissler, Olds & Lowe, P.C.

(57) ABSTRACT

A self-wrung flat mop includes a mop handle and a flat panel mop head with a backside attached to a cleaning cloth. The mop handle is coupled with an operation handgrip which is slidable up and down. The operation handgrip includes a head at a lower end. The head includes a slot and a squeezing portion at a bottom plane corresponding to the slot. The flat panel mop head has a use state and a wringing state. At the wringing state the operation handgrip is moved upward to squeeze water from the cleaning cloth via the squeezing portion. The head also includes a support plane extended transversely. When in use the entire mop (including the flat panel mop head) can be positioned upright to facilitate drying of the cleaning cloth on the flat panel mop head without touching the floor surface that might otherwise make the cleaning cloth dirty.

11 Claims, 8 Drawing Sheets

SELF-WRUNG FLAT MOP

FIELD OF THE INVENTION

The present invention relates to a self-wrung mop.

BACKGROUND OF THE INVENTION

In order to make a flat mop to squeeze water by itself many techniques have been developed and proposed in the past, such as China patent gazette Nos. ZL 200720192814.5, ZL 201220160635.4, ZL 201020144850.6 and ZL 201220188408.2. They all provide a self-wrung mop with a basic structure including a mop handle and a slidable wringing sleeve located thereon. The wringing sleeve is connected to a wringing head through a connection bar. The wringing head includes an opening with a wringing roller inside. A flat panel mop head can pass through the opening. Drawing the wringing sleeve upward the wringing roller can squeeze water contained in a mop cloth coupled on the flat panel mop head. The aforesaid self-wrung flat mop has a drawback: after the water is squeezed the flat mop cannot stand upright and the flat panel mop head has to leveled with the cleaning cloth laid on the floor surface. As a result, the cleaning cloth is difficult to be dried and also is prone to be dirty.

SUMMARY OF THE INVENTION

The primary object of the present invention is to provide a self-wrung flat mop that can be easily dried after the water has been squeezed and also is less likely to be smeared by dirt to overcome the shortcomings of the aforesaid conventional self-wrung mop.

To achieve the foregoing object the self-wrung flat mop according to the invention includes a mop handle, a flat panel mop head and an operation handgrip. The flat panel mop head is installed on a distal end of the mop handle and movable against the mop handle at a wringing state parallel with the mop handle and a use state perpendicular to the mop handle. The flat panel mop head at another side opposite to the mop handle includes a cleaning cloth located thereon. The operation handgrip is slidably installed on the mop handle and includes a movable portion coupled on the mop handle, a mask connecting portion extended integrally from the movable portion and a head connected to the mask connecting portion. The head includes a first passage run through by the mop handle, a second passage run through by the flat panel mop head, a squeezing portion corresponding to the second passage to allow the flat panel mop head to pass through and to squeeze water from the cleaning cloth, and a support plane at one end remote from the movable portion. The self-wrung flat mop has an upright holding state with the flat panel mop head entered the wringing state without overextending the support plane so that the support plane can rest on a floor surface.

In one aspect the mop handle includes a guide block, and the handgrip includes a directing portion extended from the mask connecting portion and the head to guide movement of the guide block.

In another aspect the directing portion includes two ends each being a confining end.

In yet another aspect the directing portion includes at least one positioning bulged spot.

In yet another aspect the second passage includes two guide ribs at one side remote from the cleaning cloth. Each guide rib is in contact with one side of the flat panel mop head where the cleaning cloth is not located thereon.

In yet another aspect the squeezing portion includes a scrape strip holder, a squeezing strip located on the scrape strip holder facing the cleaning cloth and a scrape strip holder spring located on the scrape strip holder to push the squeeze scrape strip to press toward the cleaning cloth.

In yet another aspect the squeezing portion includes a brush base, a brush located on the brush base to face the cleaning cloth and a brush base spring located on the brush base to push the brush to press toward the cleaning cloth.

In yet another aspect the head includes a scrape strip holder opening and a brush base opening corresponding to the squeezing portion. The scrape strip holder opening includes a scrape strip holder detent rib on an inner rim at one end faced the cleaning cloth. The scrape strip holder includes a scrape strip holder detent flange confined by the scrape strip holder detent rib. The brush base opening includes a brush base detent rib on an inner rim at one end faced the cleaning cloth. The brush base includes a brush base detent flange confined by the brush base detent rib. The head includes a detent lid located at one side of the scrape strip holder opening and the brush base opening remote from the cleaning cloth for installation of the scrape strip holder spring and the brush base spring to confine the scrape strip holder and the brush base.

In yet another aspect the scrape strip holder includes a wedge trough and the squeezing scrape strip includes a rotary shaft located in the wedge trough.

In yet another aspect the squeezing portion includes an installation base, a brush and a squeezing scrape strip located on the installation base and faced the cleaning cloth, and at least one installation base spring located on the installation base.

In yet another aspect the head includes an installation base opening corresponding to the squeezing portion that includes an installation base detent rib located on an inner rim at one side faced the cleaning cloth. The installation base includes an installation base detent flange confined by the installation base detent rib. The head includes a detent lid located at one side of the installation base opening remote from the cleaning cloth for installation of the installation base spring to confine the installation base.

In yet another aspect the flat panel mop head includes at least one latch opening at one end thereof and at one side where the cleaning cloth is not located. The self-wrung flat mop includes a cloth clamp plate hinged on the latch opening and installed on the flat panel mop head. The cloth clamp plate is latched on the latch opening via a latch lug.

The invention thus formed can provide many advantages, such as: 1. After water is squeezed the entire mop (including the flat panel mop head) can be positioned upright to facilitate drying of the cleaning cloth located on the flat panel mop head without in contact with the floor surface and getting smeared by dirt; 2. The guide block can serve as a directing means to facilitate sliding up and down of the operation handgrip and the head; 3. The flat panel mop head is guided during squeezing, and can be prevented from toppling via the guide rib; 4. The squeezing scrape strip and the brush can be adjusted automatically during squeezing according to the thickness and dirty degree of the mop; and 5. The cleaning cloth can be installed simply without loosening away easily.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
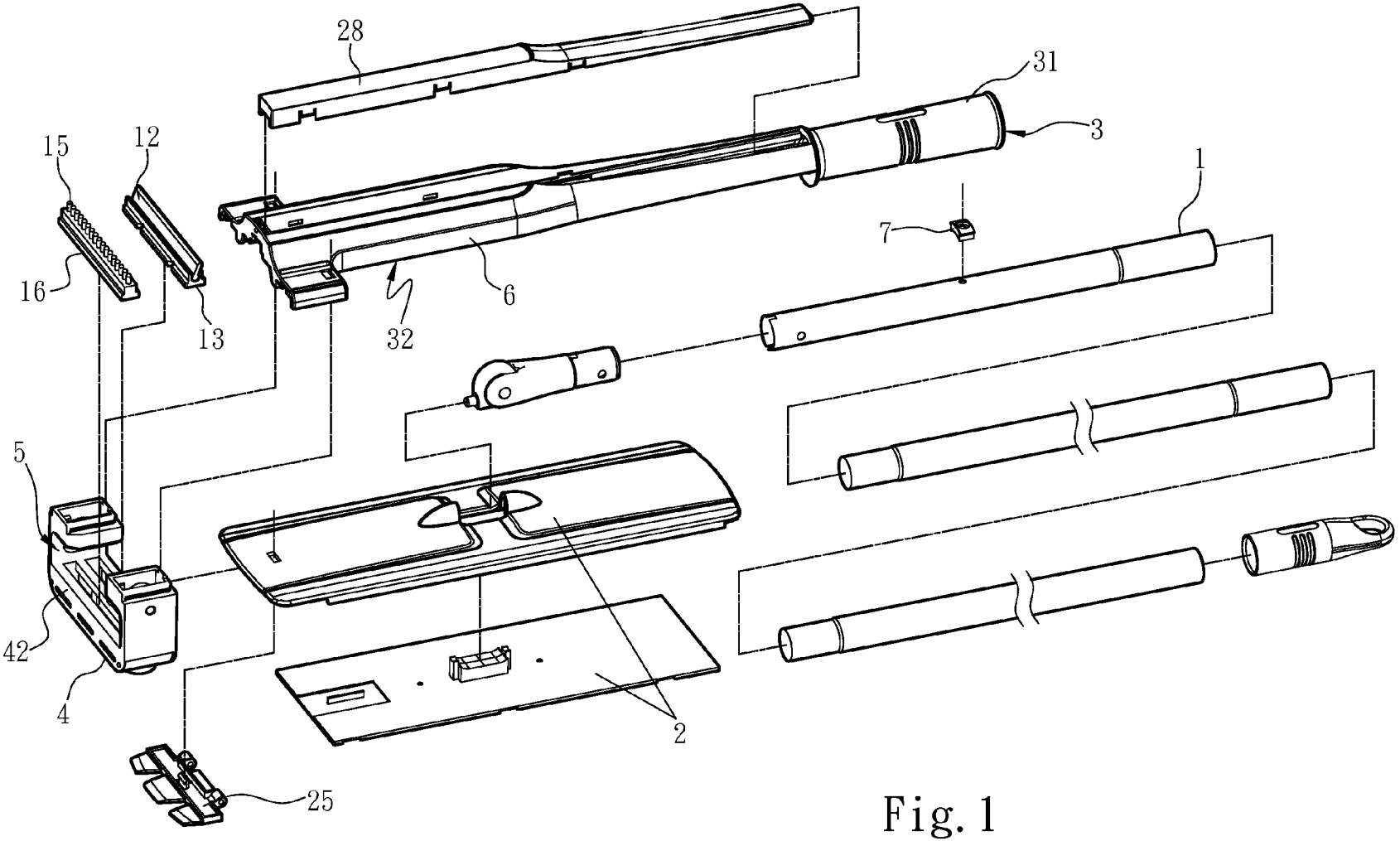
FIG. 1 is an exploded view of the invention.
Figure 2:
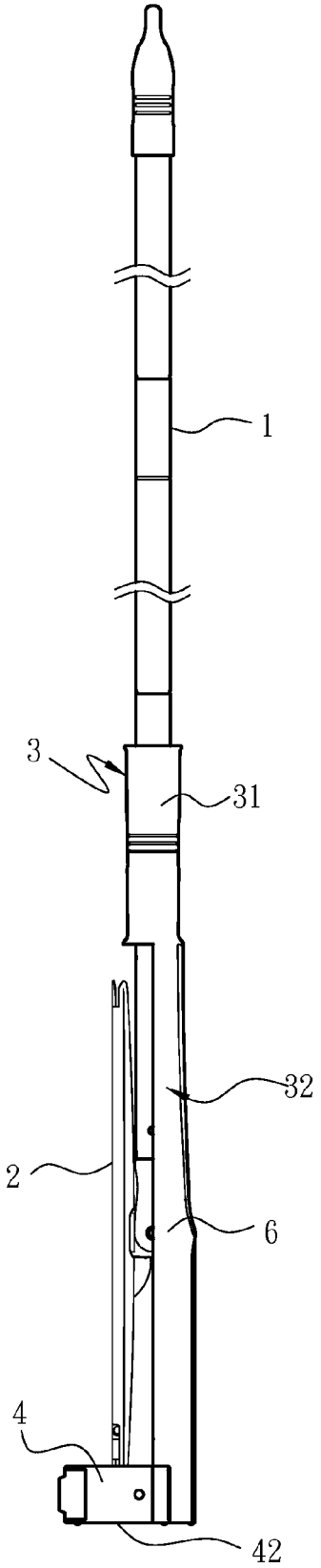
FIG. 2 is a side view of the invention at an upright condition.
Figure 3:
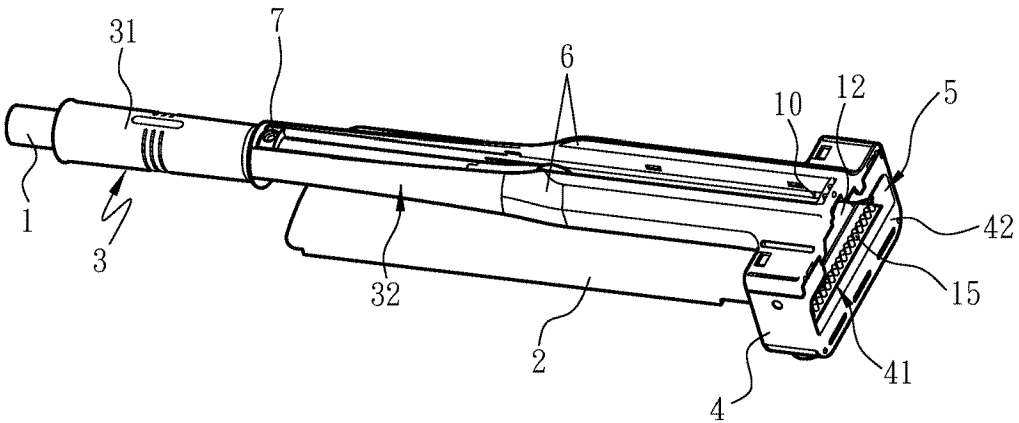
FIG. 3 is a schematic view of the invention showing the head of the operation handgrip at a lower position.
Figure 4:
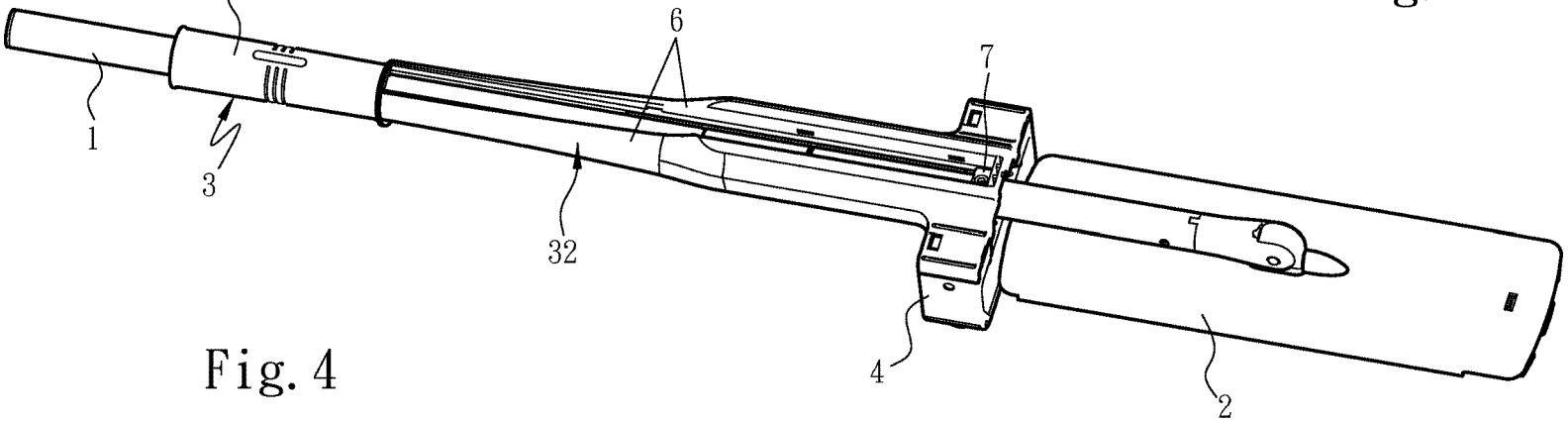
FIG. 4 is a schematic view of the invention showing the head of the operation handgrip at a higher position.

Please referring to FIGS. 1 through 10, the present invention aims to provide a self-wrung flat mop that includes a mop handle 1 and a flat panel mop head 2 with a back side attached to a cleaning cloth. The mop handle 1 includes a lower end movably connected to the flat panel mop head 2. The mop handle 1 also is coupled with an operation handgrip 3 which is slidable up and down, namely, the operation handgrip 3 can slide on the mop handle 1. The operation handgrip 3 includes a head 4 at a lower end that includes a slot 5 formed thereon. The slot 5 further defines a first passage 51 run through by the mop handle 1 and a second passage 52 run through by the flat panel mop head 2 and the cleaning cloth located thereon. The slot 5 includes a bottom plane to form a squeezing portion 41 to squeeze water out from the cleaning cloth at the back side of the flat panel mop head 2. Furthermore, the flat panel mop head 2 includes a wringing state in parallel with the mop handle 1 and a use state perpendicular to the mop handle 1; namely, the flat panel mop head 2 can be turned in parallel with the mop handle 1 to pass through the slot 5. When the head 4 is at a higher position the flat panel mop head 2 escapes the slot 5 so that the flat panel mop head 2 enters the use state in a flat position to be enabled to do mopping operation. On the other hand, when the head 4 is at a lower position the lower end of the flat panel mop head 2 passes through the slot 5 to enter the wringing state, then by moving the operation handgrip 3 upward to pass through the squeezing portion 41 water can be squeezed out from the cleaning cloth at the back side of the flat panel mop head 2.

The head 4 of the operation handgrip 3 is extended transversely to form a support plane 42. When the head 4 is at the lower position it also functions as a base so that the lower end of the flat panel mop head 2 in parallel with the mop handle 1 can be inserted into the slot 5 to enable the mop (i.e., the self-wrung flat mop) to be positioned in an upright manner, namely, the self-wrung flat mop allows the flat panel mop head 2 to enter the wringing state without overextended the support plane 42 of the operation handgrip 3 so that the support plane 42 can be rested on a floor surface to keep the self-wrung flat mop in an upright manner.

In this embodiment the operation handgrip 3 further includes a movable portion 31 coupled on the mop handle 1 and a mask connecting portion 32 integrally extended from the movable portion 31. Furthermore, the mask connecting portion 32 is connected to the head 4 and can include two connection strips 6 on the left side and the right side. The mask connecting portion 32 and the head 4 also can be integrated to form a firmer structure. The mask connecting portion 32 can further include an installation ornamental cap 28 between the two connection strips 6 on the left side and the right side to make the appearance more appealing. In addition, the mask connecting portion 32 can further include a guide block 7 which is extended to the left side and the right side to form respectively a directing wing 8. The operation handgrip 3 includes a directing portion extended to the mask connecting portion 32 and the head 4 to direct movement of the guide block 7. More specifically, the directing portion is two sets of positioning strips 9 extended from the connection strips 6 below the directing wing 8 so that the directing wings 8 and the positioning strips 9 can be collaborated to facilitate movement of the guide block 7 against the operation handgrip 3 and the head 4 to make sliding of the operation handgrip 3 and the head 4 smoother in a desired direction. In addition, the directing portion comprises two ends formed respectively a confining end. When the head 4 is at the lower position the lower end surface of the operation handgrip 3 can be hung on the guide block 7 to be confined thereof. In addition, when the head 4 is at the lower position the lower end surface of the operation handgrip 3 also can be unhung from the guide block 7 with the head 4 resting on the floor surface to hold the operation handgrip 3 and the head 4 in one set.

In another embodiment, when the head 4 is slid to the higher position the head 4 and the operation handgrip 3 are anchored via a positioning mechanism. The positioning mechanism includes at least one positioning bulged spot 10 on the directing portion. More specifically, the positioning bulged spot 10 is located on a lower end of the connection strip 6 so that when the head 4 is at the higher position the positioning bulged spot 10 presses the backside of the directing wing 8. When the operation handgrip 3 slides upward and the head 4 is located at the higher position the positioning bulged spot 10 on the connection strip 6 presses the backside of the directing wing 8 of the guide block 7 in a frictional and compressed manner so that the operation handgrip 3 and the head 4 can be anchored without sliding down. For using the next time, move the operation handgrip 3 and the head 4 downward forcefully. Of course, other positioning mechanisms also can be adopted, such as insertion pins, positioning bulged spots on the mop handle 1, and forming a positioning hole on the operation handgrip 3 so that when the operation handgrip 3 reaches the higher position the positioning bulged spot can latch in the positioning hole.

Figure 5:
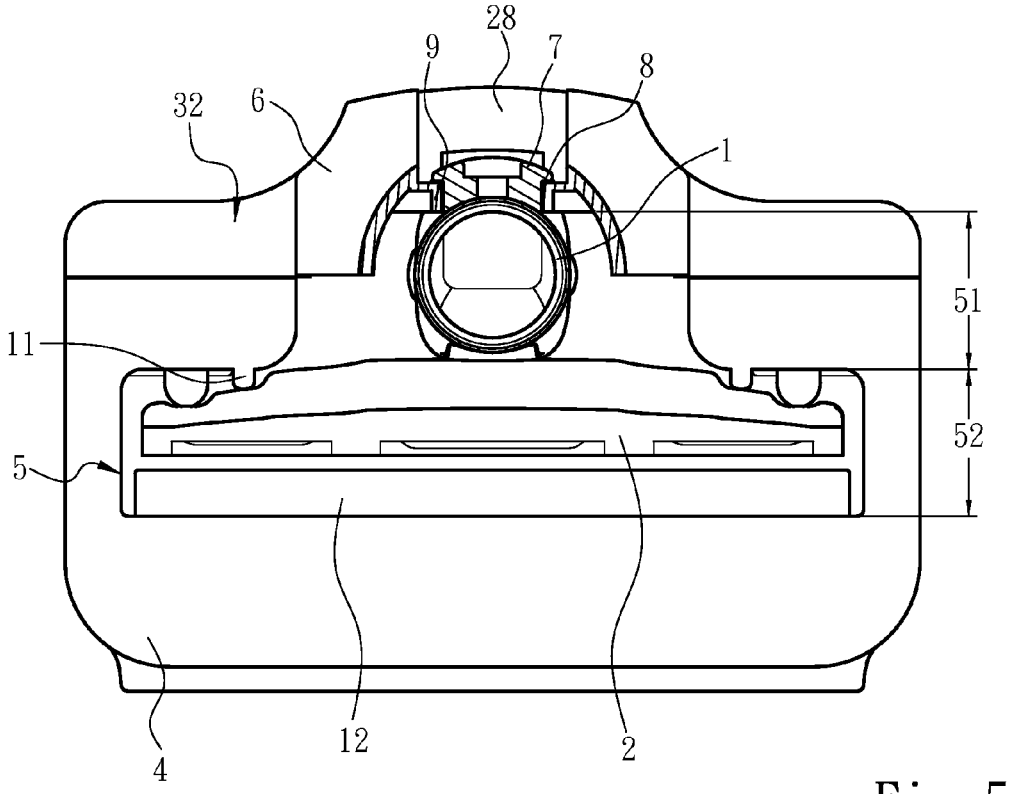
FIG. 5 is a transverse sectional view of the guide block on the mop handle.
Figure 6:
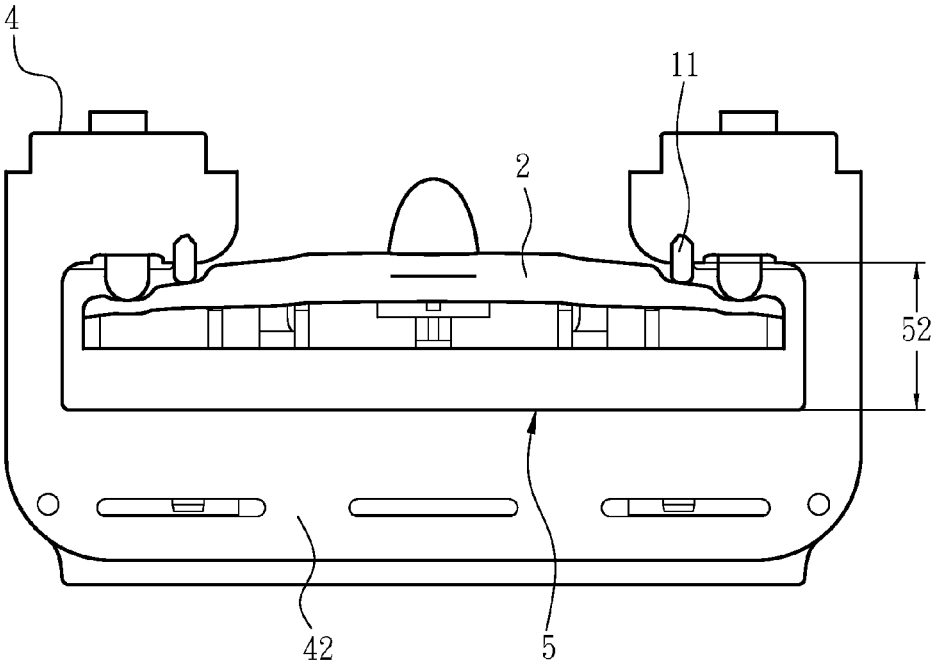
FIG. 6 is a front view of the head of the operation handgrip.

Please also referring to FIGS. 5 and 6, in this embodiment the top plane of the slot 5 includes two guide ribs 11 corresponding to two sides of the mop handle 1; namely, the guide ribs 11 are located at one side of the second passage 52 remote from the cleaning cloth so that each guide rib 11 is in contact with one side of the flat panel mop head 2 where the cleaning cloth is not located thereon. Namely, when the flat panel mop head 2 passes through the slot 5 each guide rib 11 is in contact with the front side of the flat panel mop head 2 to direct the flat panel mop head 2 during squeezing process to avoid the flat panel mop head 2 from flipping sideward.

Figure 7:
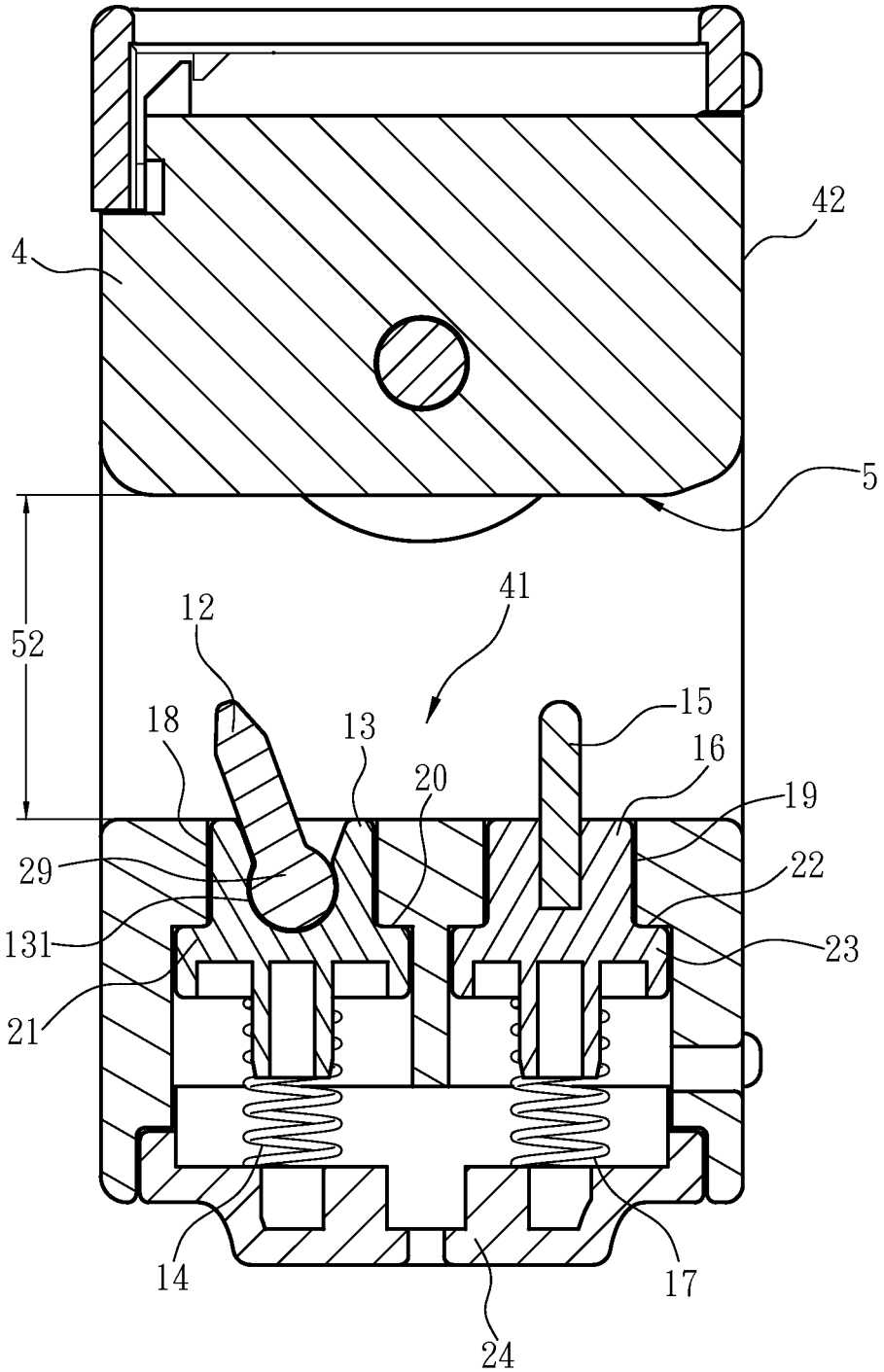
FIG. 7 is a transverse sectional view of the head of the operation handgrip.

Please referring to FIG. 7, in yet another embodiment the squeezing portion 41 of the operation handgrip 3 includes a squeezing scrape strip 12 facing the cleaning cloth. The squeezing scrape strip 12 is located on a scrape strip holder 13 which sinks into a bottom plane of the slot 5. The head 4 also includes a scrape strip holder spring 14 located on the scrape strip holder 13 to compress the squeezing scrape strip 12 toward the cleaning cloth. On the other hand, the squeezing portion 41 further includes a brush 15 facing the cleaning cloth. The brush 15 is located on a brush base 16 which also sinks into the bottom plane of the slot 5. The head 4 also includes a brush base spring 17 located on the brush base 16 to compress the brush 15 toward the cleaning cloth. When the invention is in use the squeezing scrape strip 12 scrapes water from the cleaning cloth, and the brush 15 brushes the cleaning cloth to do further cleaning thereof. In addition, the scrape strip holder spring 14 and the brush base spring 17 can automatically adjust the squeezing scrape strip 12 and the brush 15 during the squeezing process according to the thickness and dirty degree of the cleaning cloth.

Also referring to FIG. 7, for installation of the scrape strip holder 13 and the brush base 16, first form a scrape strip holder opening 18 and a brush base opening 19 on the head 4 corresponding to the bottom plane of the slot 5; the scrape strip holder opening 18 includes a side wall with a scrape strip holder detent rib 20 formed on an inner side thereof facing the cleaning cloth, and the scrape strip holder 13 includes a bottom plane with a scrape strip holder detent flange 21 mating the scrape strip holder detent rib 20. When the scrape strip holder 13 enters the scrape strip holder opening 18 from outer side the scrape strip holder detent flange 21 butts the scrape strip holder detent rib 20. On the other hand, the brush base opening 19 includes a side wall with a brush base detent rib 22 formed on an inner side thereof facing the cleaning cloth, and the brush base 16 includes a bottom plane with a brush base detent flange 23 mating the brush base detent rib 22. When the brush base 16 enters the brush base opening 19 from outer side the brush base detent flange 23 butts the brush base detent rib 22. In addition, the head 4 further is covered by a mask lid 24 from the outer side remote from the cleaning cloth. The mask lid 24 corresponds to the scrape strip holder opening 18 and the brush base opening 19 for installation of the scrape strip holder spring 14 and the brush base spring 17 with the scrape strip holder spring 14 compressed between the scrape strip holder 13 and the mask lid 24, and the brush base spring 17 compressed between the brush base 16 and the mask lid 24 so that the mask lid 24 can confine the scrape strip holder 13 and the brush base 16.

Please also referring to FIG. 7, in yet another embodiment the squeezing scrape strip 12 includes a rotary shaft 29 on a bottom plane thereof, and the scrape strip holder 13 includes a wedge trough 131 formed thereon to be wedged by the rotary shaft 29 to form a ball-hinge-like structure, thereby the squeezing scrape strip 12 can turn within a movable range and move more agilely during scraping water.

Figure 11:
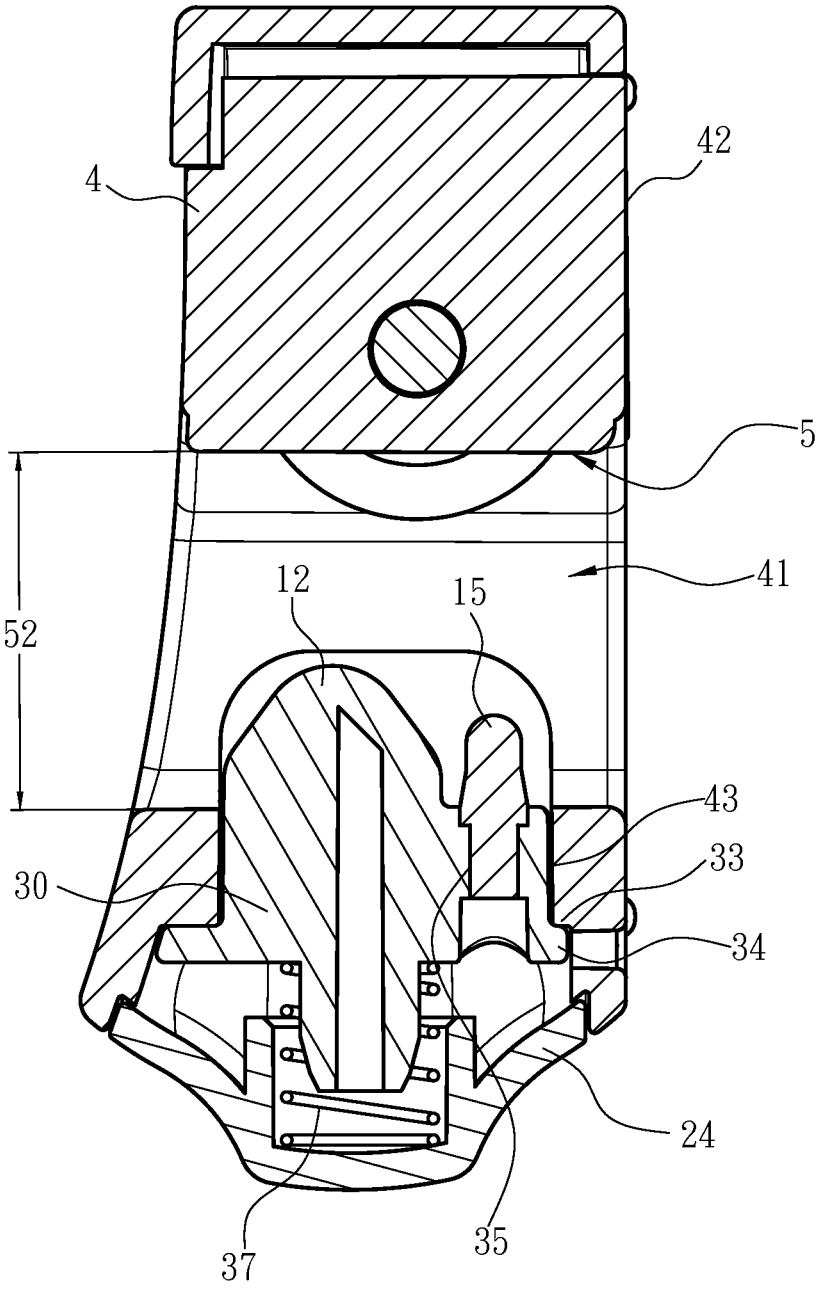
FIG. 11 is a transverse sectional view of another embodiment of the head of the operation handgrip.

Please referring to FIG. 11, in yet another embodiment on the squeezing portion 41 the scrape strip holder 13 and the brush base 16 can be integrated in an installation base 30 with the squeezing scrape strip 12 and the brush 15 located at one end of the installation base 30 facing the cleaning cloth, namely, one end facing the second passage 52. The squeezing portion 41 further includes an installation base spring 37 located on the installation base 30 to press the installation base 30 so that the squeezing scrape strip 12 and the brush 15 are pressed toward the cleaning cloth, thereby the installation base spring 37 can automatically adjust the squeezing scrape strip 12 and the brush 15 according to the thickness and dirty degree of the cleaning cloth. Furthermore, the head 4 includes an installation base opening 43 on the bottom plane of the slot 5 corresponding to the squeezing portion 41. The installation base opening 43 includes a side wall with an installation base detent rib 33 located thereon. The installation base detent rib 33 can further be located on an inner rim at one end of the installation base opening 43 faced the cleaning cloth. The installation base 30 includes a bottom plane with an installation base detent flange 34 formed thereon confined by the installation base detent rib 33. The installation base 30 can enter the installation base opening 43 from outside to make the installation base detent flange 34 to butt the installation base detent rib 33. Moreover, the squeezing scrape strip 12 and the installation base 30 can be formed in an integrated manner. The brush 15 can be located in a brush installation opening 35 formed on the installation base 30. In this embodiment the head 4 also can include the mask lid 24 located thereon.

The squeezing portion 41 also can be implemented through other approaches, such as squeezing roller in the conventional techniques.

Figure 8:
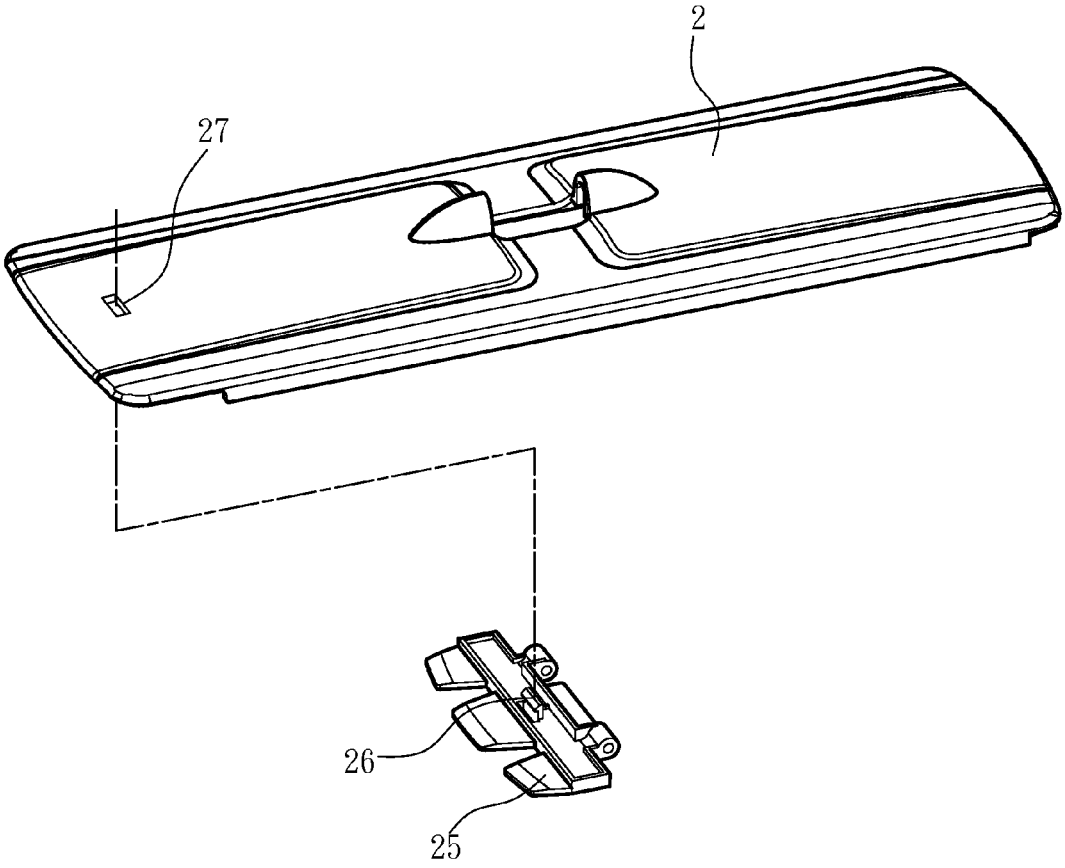
FIG. 8 is an exploded view of the flat panel mop head.
Figure 9:
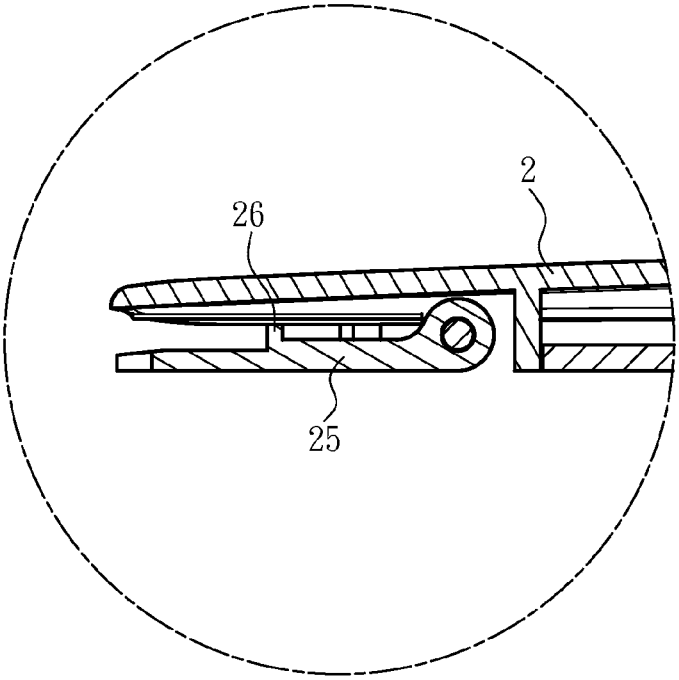
FIG. 9 is a longitudinal sectional view of the flat panel mop head with the cleaning cloth clamped by the cloth clamping plate.
Figure 10:
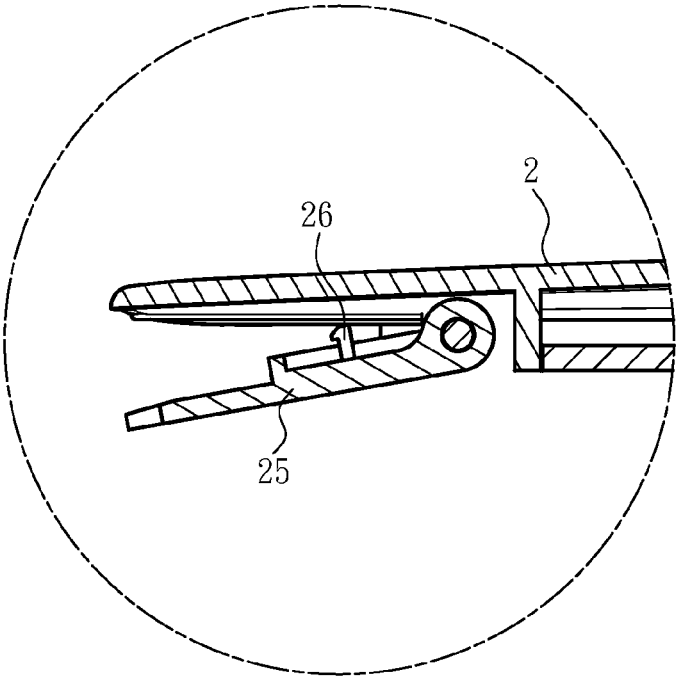
FIG. 10 is a longitudinal sectional view of the flat panel mop head with the cleaning cloth loosened by the cloth clamping plate.

Please referring to FIGS. 8, 9 and 10, in yet another embodiment the flat panel mop head 2 includes at least one cloth clamp plate 25 hinged on one end of the back side thereof. The cloth clamp plate 25 includes a latch lug 26, and the flat panel mop head 2 includes at least one latch opening 27 at one end and one side where the cleaning cloth is not located to be latched by the latch lug 26. For installation of the cleaning cloth at least one end of the cleaning cloth includes a coupling pouch (not shown in the drawings) located thereon to hold the cloth clamp plate 25 when flipped downward, then the cloth clamp plate 25 can be flipped upward, and the latch lug 26 on the cloth clamp plate 25 can be latched in the latch opening 27 of the flat panel mop head 2 to finish installation. Thus, the cleaning cloth can be installed simpler without loosening off easily after installation. Of course, the cleaning cloth can also be installed through other approaches, such as directly bonding via Velcro strips or the like.

What is claimed is:

1. A self-wrung flat mop, comprising:

a mop handle;

a flat panel mop head which is installed on a distal end of the mop handle and movable against the mop handle and includes a wringing state in parallel with the mop handle and a use state perpendicular to the mop handle, and a cleaning cloth located at another side from where the flat panel mop head and the mop handle are coupled; and an operation handgrip which is installed on the mop handle and slidable thereon and includes a movable portion coupled on the mop handle, a mask connecting portion integrally extended from the movable portion and a head connected to the mask connecting portion; the head including a first passage run through by the mop handle, a second passage run through by the flat panel mop head, a squeezing portion corresponding to the second passage to squeeze water from the cleaning cloth while the flat panel mop head passes through the second passage and a support plane at one end remote from the movable portion;

wherein the self-wrung flat mop includes an upright holding state in which the flat panel mop head enters the wringing state without overextending the support plane to allow the support plane to rest on a floor surface, wherein the operation handgrip includes a guide block and a directing portion extended from the mask connecting portion to collaborate with the head to guide movement of the guide block.

2. The self-wrung flat mop of claim 1, wherein the directing portion includes two ends each being a confining end.

3. The self-wrung flat mop of claim 1, wherein the directing portion includes at least one positioning bulged spot.

4. The self-wrung flat mop of claim 1, wherein the second passage includes two guide ribs at one side remote from the cleaning cloth, each guide rib being in contact with one side of the flat panel mop head where the cleaning cloth is not located.

5. The self-wrung flat mop of claim 1, wherein the squeezing portion includes a scrape strip holder, a squeezing scrape strip located on the scrape strip holder and faced the cleaning cloth, and a scrape strip holder spring located on the scrape strip holder to press the squeezing scrape strip toward the cleaning cloth.

6. The self-wrung flat mop of claim 5, wherein the squeezing portion includes a brush base, a brush located on the brush base and faced the cleaning cloth and a brush base spring located on the brush base to press the brush toward the cleaning cloth.

7. The self-wrung flat mop of claim 6, wherein the head includes a scrape strip holder opening and a brush base opening corresponding to the squeezing portion, the scrape strip holder opening including a scrape strip holder detent rib on an inner rim at one end thereof facing the cleaning cloth, the scrape strip holder including a scrape strip holder detent flange confined by the scrape strip holder detent rib; the brush base opening including a brush base detent rib on an inner rim at one end thereof facing the cleaning cloth, the brush base including a brush base detent flange confined by the brush base detent rib, the head including a detent lid located in the scrape strip holder opening and the brush base opening and remote from one side of the cleaning cloth for installation of the scrape strip holder spring and the brush base spring to confine the scrape strip holder and the brush base.

8. The self-wrung flat mop of claim 5, wherein the scrape strip holder includes a wedge trough and the squeezing scrape strip includes a rotary shaft located in the wedge trough.

9. The self-wrung flat mop of claim 1, wherein the squeezing portion includes an installation base, a brush and a squeezing scrape strip located on the installation base and faced the cleaning cloth, and at least one installation base spring located on the installation base.

10. The self-wrung flat mop of claim 9, wherein the head includes an installation base opening corresponding to the squeezing portion, the installation base opening including an installation base detent rib on an inner rim at one side faced the cleaning cloth, the installation base including an installation base detent flange confined by the installation base detent rib; the head including a detent lid located at one side of the installation base opening remote from the cleaning cloth for installation of the installation base spring to confine the installation base.

11. The self-wrung flat mop of claim 1, wherein the flat panel mop head includes at least one latch opening at one end thereof and at one side where the cleaning cloth is not located, the self-wrung flat mop including a cloth clamp plate hinged on the latch opening and installed on the flat panel mop head, the cloth clamp plate being assembled by coupling the latch opening with a latch lug.

* * * * *